US009016408B2

(12) United States Patent
Hörman et al.

(10) Patent No.: US 9,016,408 B2
(45) Date of Patent: Apr. 28, 2015

(54) DRILL BIT FOR A DOWN-THE-HOLE DRILL

(75) Inventors: Magnus Hörman, Älta (SE); Peter F. Johansson, Stockholm (SE)

(73) Assignee: LKAB Wassara AB, Stockholm (SE)

( * ) Notice: Subject to any disclaimer, the term of this patent is extended or adjusted under 35 U.S.C. 154(b) by 611 days.

(21) Appl. No.: 13/143,333

(22) PCT Filed: Dec. 17, 2009

(86) PCT No.: PCT/SE2009/051439
§ 371 (c)(1),
(2), (4) Date: Sep. 30, 2011

(87) PCT Pub. No.: WO2010/082889
PCT Pub. Date: Jul. 22, 2010

(65) Prior Publication Data

US 2012/0012399 A1 Jan. 19, 2012

(30) Foreign Application Priority Data

Jan. 14, 2009 (SE) ..... 0900035

(51) Int. Cl.
*E21B 10/36* (2006.01)
*E21B 1/00* (2006.01)

(52) U.S. Cl.
CPC .. *E21B 10/36* (2013.01); *E21B 1/00* (2013.01)

(58) Field of Classification Search
CPC ..... E21B 10/36; E21B 1/00
USPC ..... 175/414, 293
See application file for complete search history.

(56) References Cited

U.S. PATENT DOCUMENTS

| | | | | |
|---|---|---|---|---|
| 3,269,470 | A * | 8/1966 | Kelly, Jr. | 175/426 |
| 4,003,442 | A | 1/1977 | Bassinger | |
| 8,109,348 | B2 * | 2/2012 | Lorger et al. | 175/296 |
| 2006/0060388 | A1 * | 3/2006 | Linden et al. | 175/414 |
| 2009/0255735 | A1 * | 10/2009 | Swadi et al. | 175/420.2 |

FOREIGN PATENT DOCUMENTS

| | | | |
|---|---|---|---|
| WO | 95/25872 | A1 | 9/1995 |
| WO | 96/30620 | A1 | 10/1996 |

(Continued)

OTHER PUBLICATIONS

International Search Report received for PCT Patent Application No. PCT/SE2009/051439, mailed on May 4, 2010, 6 pages.

*Primary Examiner* — Cathleen Hutchins
(74) *Attorney, Agent, or Firm* — Morrison & Foerster LLP

(57) ABSTRACT

The invention concerns a drill bit, intended to be used with a down-the-hole drill and comprising a drill head (2) with a front surface provided with drill pins (3) and a shaft (4), whereby the shaft is narrower than the drill head and intended to be inserted in a manner that allows axial sliding into the end of a drill chuck that is a component of a down-the-hole drill and which shaft has a rear end part (6) that is somewhat thickened with a plane striking surface (7) against which a hammer piston (8) that is a component of the down-the-hole hammer drill is arranged to impact, that the drill head when viewed along its axial direction has a cylinder-shaped forward part (20) provided with cuttings channels (22), a rear cylinder-shaped part (21) that is located for the reception of drill cuttings at the same level or somewhat below the bottom (25) of the cuttings channels, whereby the diameter (D1) of the forward part is greater than the diameter (D2) of the rear part. In a drill bit that has high performance and a long useful life, and that is furthermore well-suited to be used for directed drilling, the cylinder-shaped forward part (20) of the drill head (2) has an axial length (L3) from the main plane of the front surface to a shoulder plane (26) located between the drill head (2) and the shaft (4) that is greater than the axial length (L4) of the cylinder-shaped rear part (21) of the drill head.

11 Claims, 2 Drawing Sheets

(56) References Cited

FOREIGN PATENT DOCUMENTS

Figure 1:
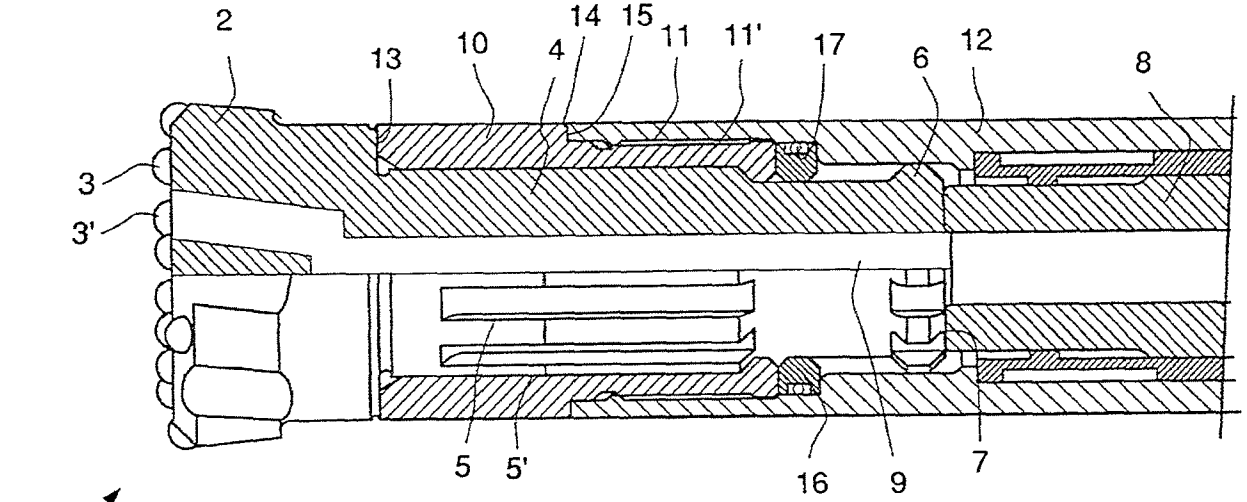
FIG.1 Prior art

| | | | |
|---|---|---|---|
| WO | 97/08421 | A1 | 3/1997 |
| WO | 98/58154 | A1 | 12/1998 |
| WO | 2007/010513 | A1 | 1/2007 |
| WO | 2007/077547 | A1 | 7/2007 |

* cited by examiner

DRILL BIT FOR A DOWN-THE-HOLE DRILL

CROSS REFERENCE TO RELATED APPLICATIONS

This is a U.S. National Phase patent application of PCT/SE2009/051439, filed Dec. 17, 2009, which claims priority to Swedish Patent Application No. 0900035-7, filed Jan. 14, 2009, each of which is hereby incorporated by reference in the present disclosure in its entirety.

The present invention concerns a drill bit for a down-the-hole drill according to the introduction to claim 1.

Not only the force of rotation, but also an impact force in the form of impact energy, are transferred during down-the-hole drilling from a drill rig to a down-the-hole hammer drill, which is inserted into the drill-hole that is to be drilled The force of rotation is transferred with the aid of an external pipe that can be rotated and that causes one end of the external pipe attached to the drill bit to rotate, while the impact force is transferred with the aid of a piston that can be displaced forwards and backwards along the longitudinal direction of the external pipe and positioned inside of it. A chuck or other transfer means is used for the transfer of the force of rotation, this means being fixed screwed to the external pipe, while a set of splines are present inside of the transfer means, which splines interact with external splines on the shaft of the drill bit, whereby the drill bit is limited axially movable in the transfer means through the interaction between the said splines or splined connector such that it can be displaced along the axis in the transfer means.

The loads experienced by the component materials have increased as the powers delivered by the drill rigs have increased, in particular since the introduction of liquid-driven rigs. The drill bits of down-the-hole drills that are primarily used for drilling in hard rock for, for example, drilling for water wells or drilling holes for explosive charges, are subject to very heavy loads. Problems particularly arise with the formation of cracks and the following fracture of the shaft of the drill bit at the splined connector between the transfer means and the said shaft. The said cracks can result in machine failure through the shaft of the drill bit, quite simply, breaking. This in turn can lead to the drill bit being lost and remaining in the drill-hole, which means that a completely new hole must be drilled. In recent years, down-the-hole hammer drills have come more and more to be used for what is known as "directed drilling", which involves the drilling of holes that are not straight. The rock drill is exposed to very severe angles of attack during directed drilling, and to very large bending forces as a result of this. This is true in particular for the forward part of the drill bit, which is significantly thicker. This part is known as the "drill head" and has the form of an overhang in the direction of drilling, protruding in front of the transfer means and forming in this way a form of lever, the pivot point of which is located in the region at which the rear part, or shoulder, of the drill bit passes over into the shaft, which has a diameter that is significantly smaller. It should be understood that particularly large bending loads arise at this part in drill bits with long overhangs, formed by axially extended drill heads that protrude from the transfer means.

The aim of the present invention is to achieve a drill bit for a down-the-hole hammer drill with which the problems described above can be alleviated. In particular, it is desired to achieve a drill bit with high performance and long useful life, and a drill bit that is well-suited to be used for directed drilling.

The aim described above of the invention is achieved with a drill bit for a down-the-hole drill that demonstrates the characteristics and properties that are specified in claim 1.

The insight that forms the basis of the invention is that the shaft, and thus also the active force-absorbing area of the splined connector, can be increased by a redistribution of the inactive material that is located in the cylindrical part of the drill bit behind the drill head, such that it is located on the shaft of the drill bit. This can be carried out without having a negative effect on the weight or other properties of the drill bit. Through the facts that redistribution of the material leads to a reduction in the cylindrical rear part of the drill bit in its axial direction, and that the shoulder impact surface is displaced forwards, the actual total axial length of the drill head is reduced, and thus also that part of the length of the drill bit that protrudes in front of the transfer means or external pipe of the down-the-hole hammer, the part known as the "overhang". A consequence of this is that the bending forces that arise in drill bits during directed drilling are reduced.

Figure 2:
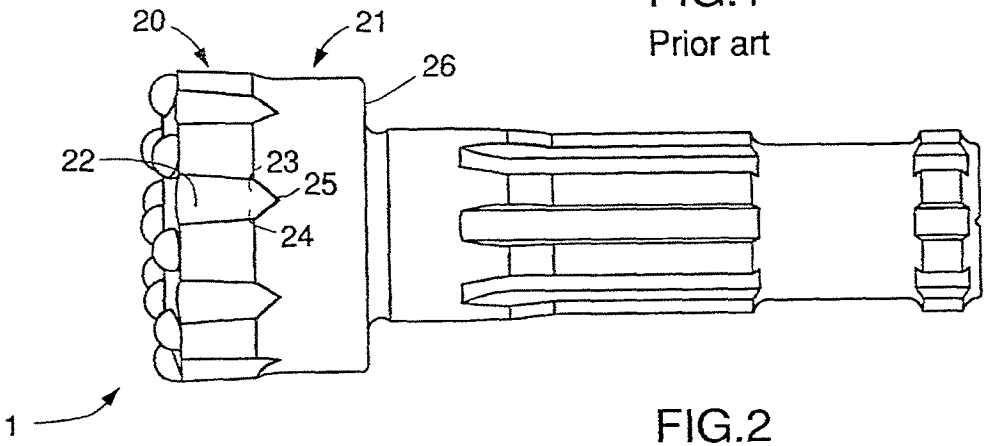
FIG.2 Prior art
Figure 3:
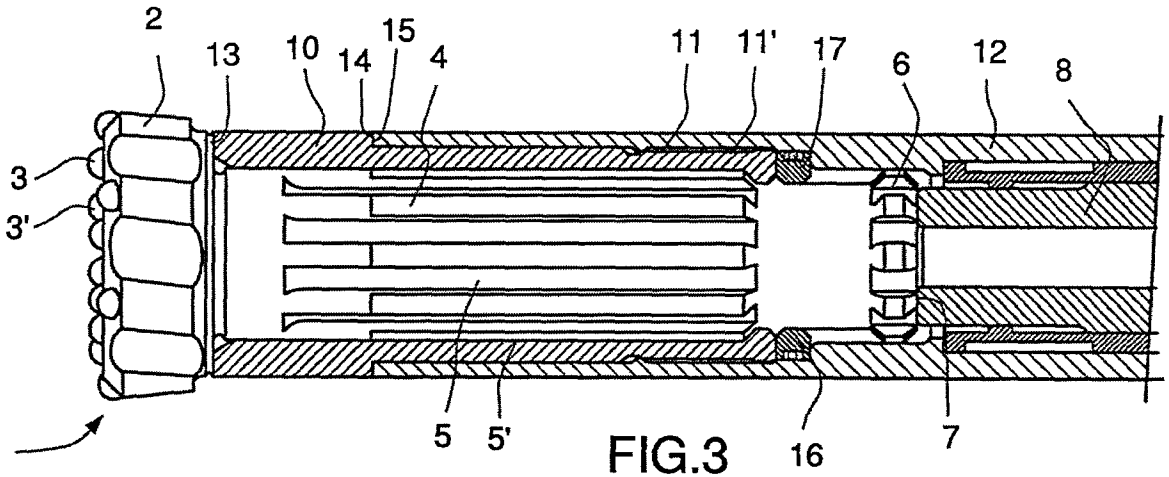
Figure 4:
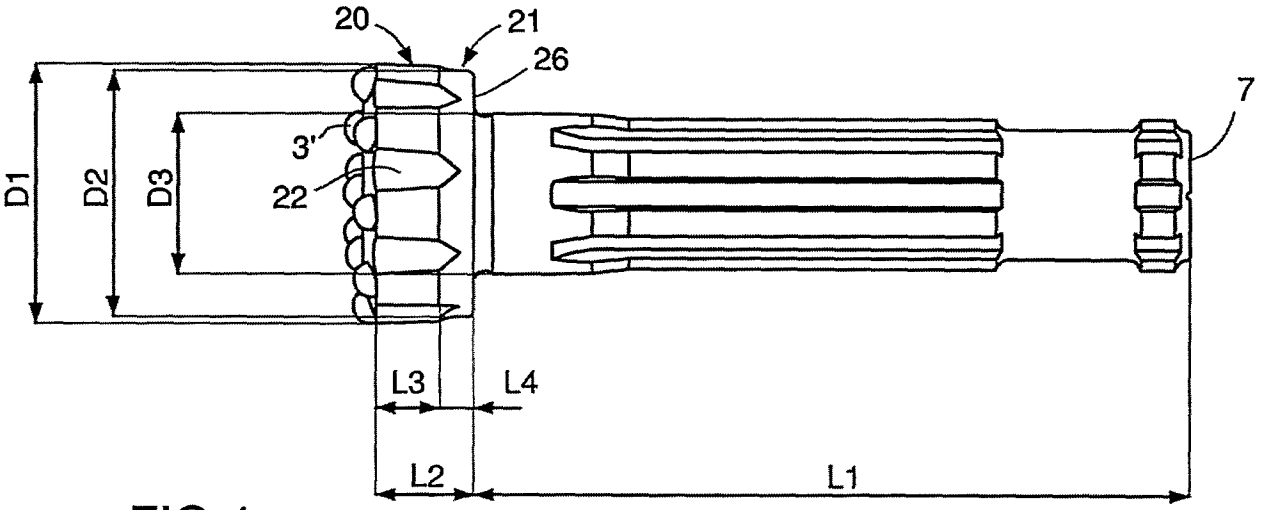

The invention will be described in more detail below with the aid of a non-limiting embodiment that is shown in the attached drawings, in which:

FIG. 1 shows a longitudinal section through a down-the-hole hammer drill with parts that are located adjacent to the drill bit, according to prior art technology, FIG. 2 shows a side view of a drill bit of the type that is used in the down-the-hole hammer drill shown in FIG. 1, FIG. 3 shows a longitudinal section through a down-the-hole hammer with a drill bit according to the present invention and parts that are located adjacent to the drill bit, and FIG. 4 shows a side view of a drill bit according to the present invention.

FIG. 1 shows a known drill bit 1 intended to be used in a liquid-driven down-the-hole hammer drill. In the forward part 2 of the drill bit 1, the part known as the "drill head", a number of pins 3 of, for example, hard metal have been inserted in order to be able to drill through rock. The drill bit 1 further comprises a shaft 4 that originates at the drill head 2 and whose diameter is considerably smaller than that of the head. The shaft 4 is provided with longitudinal splines 5. The drill bit 1 has a rear end part 6 that is somewhat thickened with a flat plane of contact 7, against which a hammer piston 8 that is a component of the down-the-hole hammer drill is arranged to impact. The drill bit 1 internally has a longitudinal rinsing channel 9 to lead rinsing fluid away through openings in the front part of the drill bit. The tasks of the said rinsing fluid are not only to act as a coolant but also to transport drill cuttings from the front part of the drill bit 1 and onwards out of the drill-hole back along the outer surface of the drill bit.

The down-the-hole hammer drill has a transfer means 10 for interaction with the longitudinal splines 5 on the shaft 4 of the drill bit, which transfer means is internally provided with splines 5' corresponding to the splines 5 of the shaft 4. The transfer means 10 has the form of a sheath and is externally provided with a thread 11 along at least a part of its length, by which thread the transfer means is screwed attached at the front end of an external pipe 12 provided with an internal thread 11' that corresponds to the thread of the transfer means such that the said external pipe at least partially surrounds not only the transfer means but also the shaft of the drill bit. The external pipe 12 surrounds also the hammer piston 8. The transfer means 10 has a plane end surface 13 at its front end and a shoulder 14, against which a plane end surface 15 of the external pipe 12 makes contact when the transfer means is fixed to the external pipe.

A stop ring 16 is positioned in a compartment formed as an indentation having the form of a track in the inner surface of the external pipe. The task of the stop ring 16 is to prevent the drill bit 1 from falling out of the external pipe and to limit the axial movement of the drill bit forwards during drilling. The threaded connection 11, 11' of the transfer means is not in principle placed under any load from any torque during the drilling: essentially all torque is absorbed by the splined connector. The down-the-hole hammer drill can be extended by joints and can form a drill string of the desired length. Through the influence of a drill rig, the external pipe 12 is given a rotational motion that is transferred to the transfer means 10, which in turn transfers this rotational motion by means of the splined connector to the drill bit 1 such that this rotates a pre-determined number of degrees in association with each impact.

During all drilling, and in particular during the drilling of long holes from which large quantities of drill cuttings are removed, a space known as the "clearance" must be created between the wall of the drilled hole and the drill string. In order to achieve the said clearance space, the drill head 1 has an external diameter that exceeds the external diameter of the external pipe 12 and the drill bit is for this purpose provided with pins that are partially directed radially outwards.

As is made most clear by FIG. 2, the drill head 2 when seen in the direction of its axis has a forward cylindrical part 20 and a rear cylindrical part 21, whereby the forward part, in order to form the clearance space, has a diameter that is somewhat larger than both the diameter of the rear part and the diameter of the external pipe. The forward part 20 is provided on its peripheral outer surface with a number of cuttings channels 22 that extend along the longitudinal or axial direction of the drill bit and whose task is to lead drill cuttings and rinsing liquid away from the front of the drill bit backwards along a part of the length of the transfer means 10 and onwards along the outer surface of the external pipe 12. The cuttings channels 22 are evenly distributed around the circumference or the periphery of the head of the drill bit. Each cuttings channel 22 is limited by first and second cuttings surfaces 23, 24 that meet in a valley 25 that lies along the line of the periphery of the rear part 21 and opens out across it. The rear part 21 is depressed relative to the forward part 20 of the drill head 2 in such a manner that the periphery of the rear part is located at essentially the same level as the bottom of the valley 25, in order to offer a low resistance to the removal of cuttings. The transition between the said rear part 21 and the shaft 4 has been designed as a shoulder impact surface 26, which interacts with the forward end surface 13 of the transfer means 10 and limits the withdrawn rear position of the drill bit. The transfer means 10 has at its end part that faces the head 2 of the drill bit 1 an external diameter that essentially corresponds to the external diameter of the said rear part 21 of the drill head and forms in this way an extension of this.

The invention is shown in FIGS. 3 and 4, whereby excess material from the cylindrical rear part 21 of the drill bit has been redistributed backwards to the shaft 4 such that the said material forms force-absorbing parts in the form of a splined connector 5, 5' with a large force-absorbing area. The shaft 4 has thus been extended while retaining essentially the same or, if this is desirable, a somewhat lower, weight than that of the prior art drill bit shown in FIG. 2. While the extent of the cylindrical rear part 21 has been reduced in the axial direction, the shoulder impact surface 26 at the transition to the shaft has been located in very close proximity to that part of the cuttings channels 22 of the drill head 2 that open out backwards towards the outer periphery of the transfer means. Furthermore, the shaft 4, and thus also the splines 5, have been extended, whereby it is appropriate that the transfer means be assigned the corresponding extended splines 5' in the form of ridges and grooves.

A drill bit 1 according to the present invention is shown in FIG. 4 whereby L1 denotes the axial length of the shaft 4 from the shoulder 26 to the end surface 7, L2 denotes the total length of the drill head 2 from the principal plane of the front surface to the shoulder plane, thus comprising both the cylinder-shaped forward part 20 and the rear part 21, L3 denotes the axial length of the cylinder-shaped forward part 20 of the drill head, and L4 denotes the axial length of the cylinder-shaped rear part of the drill head. Furthermore, D1 denotes the greatest diameter of the drill head 2 measured at the cylinder-shaped forward part 20 of the drill head, which diameter is the circle that forms a tangent with the solid parts of the drill head that are located at a greatest distance from the centre, between the cuttings channels 22; D2 is the diameter of the cylinder-shaped rear part 21 of the drill head, and D3 is the greatest diameter of the shaft 4. The ratio D1/D2 is always greater than 1, and always less than 1.25: it is preferable that the said ratio is approximately 1.05. The outermost part of the shoulder describes a circle, the diameter of which, it should be realised, is an extension of the cylinder-shaped rear part 21 of the drill bit 1.

The greatest diameter D3 of the shaft 4 forms an imaginary cylinder that extends forwards towards the front surface of the drill bit and intersects at least some of the pins 3' that are located centrally in the front surface, mainly in the centre, or in the vicinity of the central part, of the active crushing surfaces of the said central pins. The diameter selected for the shaft 4 relative to the locations of the central pins 3' at the front of the drill bit leads impact energy towards the area of the centre of the drill bit, i.e. in a direction towards the centre of gravity of the drill head. It should therefore be understood that the impact energy that is transferred to the end surface 7 of the shaft 4 is led onwards and forwards to those parts of the front of the drill bit where it has the greatest benefit.

As is made clear by the drawings, the external pipe 12 has a uniform external diameter that essentially corresponds to the external diameter D2 of the cylindrical rear part 21 of the drill bit 1. Thus, the outer peripheries of the said parts lie essentially in line with each other. Furthermore, the total axial length L2 of the drill head 2 has been chosen such that it is always less than the axial length L1 of the shaft 4 from the shoulder 26 to the end surface 7, and in addition the axial length L4 of the rear part 21 of the drill head 2 has been chosen such that it is always shorter than the axial length L3 of the forward part 20 of the drill head. The ratio L3/L4, i.e. the length L3 of the forward part of the drill head relative to the axial length L4 of the cylinder-shaped rear part of the drill head, is always greater than 1. It is appropriate that the ratio L3/L4 lie in the interval from 2 to 4, it is preferable that the said ratio be approximately 3. The ratio between the total axial length L2 of the drill head 2 and the axial length L1 of the shaft 4 from the shoulder 26 to the end surface 7, i.e. L2/L1, is less than 0.3, preferably 0.15.

The invention is not limited to what has been described above and shown in the drawings: it can be changed and modified in several different ways within the scope of the innovative concept defined by the attached patent claims.

The invention claimed is:

1. A drill bit, intended to be used with a down-the-hole drill and comprising a drill head with a front surface provided with drill pins and a shaft, whereby the shaft is narrower than the drill head and intended to be inserted in a manner that allows axial sliding into the end of a drill chuck that is a component of a down-the-hole drill and which shaft has a rear end part that is somewhat thickened with a plane striking surface against which a hammer piston that is a component of the down-the-hole hammer drill is arranged to impact, the drill head when viewed along an axial direction thereof has a cylinder-shaped forward part provided with cuttings channels to lead away drill cuttings, a rear cylinder-shaped part that is located for the reception of drill cuttings at the same level or somewhat below the bottom of the cuttings channel, whereby the diameter of the forward part is greater than the diameter of the rear part, and the cylinder-shaped forward part and the cylinder-shaped rear part of the drill head have respective axial lengths, whereby the cylinder-shaped rear part terminates at a shoulder impact surface facing a forward end surface of the drill chuck, wherein the axial length of the cylinder-shaped forward part of the drill head is greater than the axial length of the cylinder-shaped rear part of the drill head, and wherein the shoulder impact surface of the cylinder-shaped rear part is held abutted to an outer edge of the chuck.

2. The drill bit according to claim 1, whereby the total axial length of the drill head has been selected so as to be always less than the axial length of the shaft calculated from the shoulder impact surface to an end surface or the striking surface of the shaft.

3. The drill bit according to claim 1, whereby the ratio of axial lengths of the forward part and the rear part of the drill head lies in the interval 2-4.

4. The drill bit according to claim 1, whereby the ratio between the diameter of the forward part and the diameter of the rear part of the drill head lies in the interval 1-1.25.

5. The drill bit according to claim 1, whereby the ratio between the total axial length of the drill head and the axial length of the shaft from the shoulder to the end surface, is always less than 0.3.

6. The drill bit according to claim 1, whereby the greatest diameter of the shaft forms an imaginary cylinder that extends forwards towards the front surface of the drill head and intersects at least some drill pins that are located centrally in the front surface, mainly in a centre or in the vicinity of a central part of an active crushing surface of the pins.

7. The drill bit according to claim 1, whereby the ratio of axial lengths of the forward part and the rear part of the drill head is 3.

8. The drill bit according to claim 1, whereby the ratio between the diameter of the forward part and the diameter of the rear part of the drill head is 1.05.

9. The drill bit according to claim 1, whereby the ratio between the total axial length of the drill head and the axial length of the shaft from the shoulder to the end surface, is always less than 0.15.

10. The drill bit according to claim 1, wherein the forward part is angled and the rear part is levelled with respect to an axis of the drill shaft.

11. The drill bit according to claim 1, wherein there is a step on a sidewall of the drill head between the forward part and the rear part.

* * * * *